US005211307A

United States Patent [19]

Jeffries

[11] Patent Number: 5,211,307

[45] Date of Patent: May 18, 1993

[54] INSULATED CONTAINER HOLDER

[76] Inventor: Nam T. Jeffries, 2609 Wagon Wheel Dr., Mobile, Ala. 36695

[21] Appl. No.: 711,204

[22] Filed: Jun. 6, 1991

[51] Int. Cl.[5] ..... A47I 45/00

[52] U.S. Cl. ..... 220/739; 220/771

[58] Field of Search ..... 220/85 H, 737, 739, 220/753, 771

[56] References Cited

U.S. PATENT DOCUMENTS

| | | | |
|---|---|---|---|
| 1,462,291 | 7/1923 | McCrinic | 220/85 H |
| 1,617,213 | 2/1927 | Paugh | 215/100 A |
| 1,683,772 | 9/1928 | Gibson | 220/85 H |
| 2,116,148 | 5/1938 | Hawley | 220/85 H |
| 2,981,562 | 4/1961 | Long | 215/100 A |
| 3,094,258 | 6/1963 | Punke | 220/85 H |
| 3,599,362 | 8/1971 | Klober | 215/100 A |
| 4,681,239 | 7/1987 | Manns et al. | 220/85 H |
| 4,796,937 | 1/1989 | Andrea | 220/85 H |
| 4,817,810 | 4/1989 | Shull | 220/85 H |
| 4,951,831 | 8/1990 | Roesch et al. | 220/404 |
| 4,982,869 | 1/1991 | Robbins | 220/85 H |

FOREIGN PATENT DOCUMENTS

| | | | |
|---|---|---|---|
| 83916 | 11/1957 | Denmark | 220/85 H |

*Primary Examiner*—Joseph Man-Fu Moy
*Attorney, Agent, or Firm*—Keaty & Keaty

[57] ABSTRACT

The invention relates to container holders and more particularly to an insulated container holder for retaining infant bottles. The holder body has an open top and bottom wall, a continuous side wall, the inner side wall defining a central opening which extends from the open top to the bottom wall. A pair of handles are integrally unitary attached at diametrically opposite sides of the continuous side wall to form gripping handles. An elongated slot is formed through the thickness of the side wall to allow observation of level of contents in the container positioned within the holder. The inner wall exerts a discreet compression force on the container positioned within the central opening and prevents its sliding or slipping out of the holder when the infant tilts the holder and the container. The bottom wall is provided with an aperture to allow the escape of air when the container is being pushed into the central opening of the holder.

1 Claim, 1 Drawing Sheet

INSULATED CONTAINER HOLDER

BACKGROUND OF THE INVENTION

The present invention relates to an insulated holder for a container, and more particularly to an insulated container for holding generally cylindrical objects, such as for example baby bottles.

It is the general objection of insulated enclosures or holders to retain contents of a holder position therein at a temperature other than the ambient temperature of the environment. Various devises have been proposed for satisfying this objective which can be used with cylindrically or generally cylindrically-shaped containers, such as for example soft drink cans.

Some of the devices are also proposed for insulating beverage containers by completely enclosing the containers. Such insulating enclosure is illustrated in U.S. Pat. No. 4,871,597 issued on Oct. 3, 1989 to Michael A. Hobson and entitled "Light-Weight Multi-Layer Insulating Enclosure".

While these devices satisfy general purposes, still they lack the advantage of being adapted for use with baby bottles and which could serve not only as merely isolating containers but also holders with handle which and infant can hold without assistance from a parent.

The present invention contemplates provision of an isolated container holder which can be used as a holder for baby bottles and which can be held by the infant without assistance of the parent.

SUMMARY OF THE INVENTION

The present invention achieved its objects by provision of an insulated holder which is formed from a lightweight porous flexible, resilient material.

The container holder comprises a holder body which has an open top, bottom wall, a substantially cylindrical continuous inner wall and a substantially cylindrical outer wall. The inner wall defines a central opening which extends from an open top to a bottom wall of the holder A pair of handles are integrally unitary formed at diametrically opposite sides of the outer continuous side wall, each handle being formed by a convex outer surface and a concave inner surface, the latter being spaced from the outer side wall to allow gripping of the handles by the user, such as an infant. The side wall is provided with an elongated slot which extends in parallel relationship to a longitudinal axis of the holder and allows determination of the level of contents in the container which is inserted into the central opening by a parent. The central opening is sized and shaped to be equal or just slightly greater than the outer dimensions of the container and the inner continuous side wall exerts a slight compression force on the container to securely frictionally engage the container and prevent it from sliding from within the holder and potentially slipping from the holder, which might create dangerous conditions for the infant.

To allow escape of the air which may be compressed and trapped within the holder when the container is being pushed within the central opening of the holder, the bottom wall is provided with an opening to allow escape of air and facilitate positioning of the container within the holder.

It is therefore an object of the present invention to provide an insulated container holder suitable for use by infants.

It is a further object of the present invention to provide an insulated container holder which securely engages and retains the container within the holder.

It is a further object of the present invention to provide a container which is easy and inexpensive to manufacture.

It is further object of the present invention to provide a container holder which is lightweight and convenient enough to be handled by an infant.

These and other objects of the present invention will become apparent to those skilled in the art from the following detailed description of the invention.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figure 1:
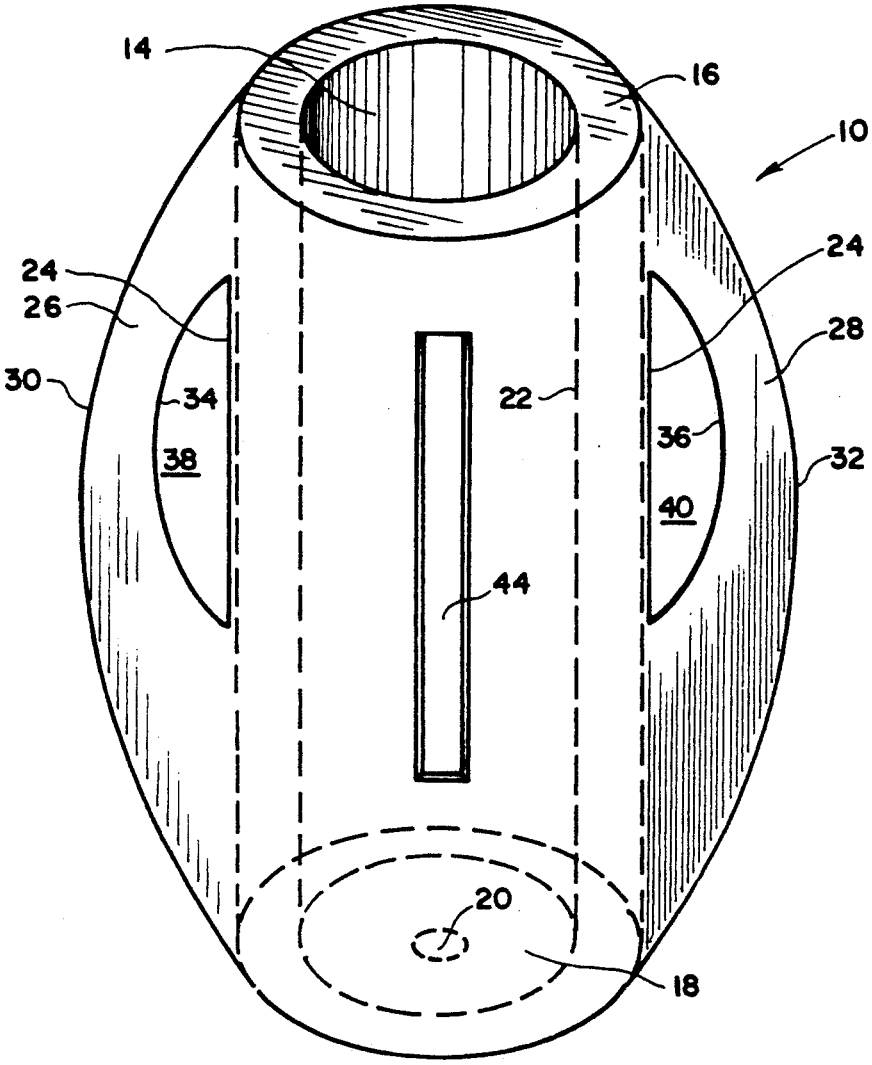
FIG. 1 is a perspective plan view of the container holder in accordance with the present invention.
Figure 2:
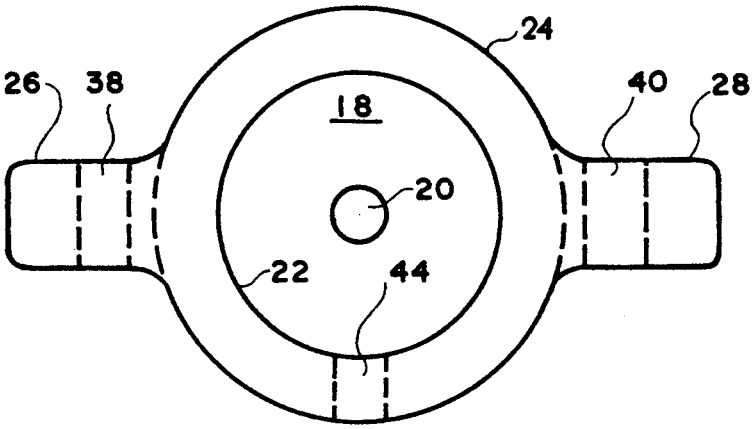
FIG. 2 is a top plan view of the holder illustrated in FIG. 1.

Referring to the drawings in more detail, the insulated container holder in accordance with the present invention is generally designated by numeral 10. The holder 10 comprises a unitary integral body 12 having a central opening 14 extending from a top end 16 of the body 12 substantially towards the closed bottom 18.

A smaller diameter opening 20 is formed through the thickness of the bottom wall 18, the function of which will be explained in more detail hereinafter.

An interior wall 22 defines the generally cylindrical opening 14 and is sized and shaped to receive a cylindrical or generally cylindrical bottle therein. The size of the opening 14 is such as to be approximately equal or just slightly greater than the size of a standard infant bottle, so as to frictionally engage the walls of the bottle for at least a major part of the length of the bottle.

The material utilized in manufacturing the holder body 12 is preferably lightweight, porous resilient substance which can stretch at least slightly under the pressure exerted by the bottle positioned within the central opening 14. Once the bottle is positioned within the holder 10, the interior wall 22 exerts a slight compression force on the walls of the bottle positioned within the holder 10, thus assisting in retaining the bottle and preventing its axial movement or slipping out when the holder 10 and the thus the bottle positioned therein are tilted during normal feeding process by the infant.

As can be seen in the drawings, the holder body 12 further comprises a generally cylindrical outer wall 24 and a pair of handle means 26 and 28 which project diametrically opposite from each other and are integrally unitary formed with a exterior wall 24.

Each handle means 26 and 28 comprises an exterior convex wall 30 and 32, respectively, as well as a concave inner wall 34 and 36, respectively. The concave walls 34 and 36 are spaced from the exterior wall 24 by spaces 38 and 40 which are sized large enough to enable an infant to grip the holder by the handle means 26 and 28 and to insert his fingers into the spaces 38 and 40, firmly encircling the handles 26 and 28.

An elongated slot 44 is formed through the wall of the body 12 extending from the outer wall 24 to the inner wall 22. The slot 44 extends vertically in parallel relationship to a longitudinal axis of the body 12 from a distance adjacent to an upper end 16 of the housing 12 to a distance above the bottom 18 of the housing 12. The elongated slot 44 allows visual observation of the level of the contents in the container positioned within the holder 10 and easy determination of such level. In this manner, the parent can easily determine when the container is nearly empty and remove it from the holder 10 when necessary.

As was mentioned above, the opening 14 is just slightly greater or equal to the exterior diameter or periphery of an infant feeding bottle. Therefore, when the bottle is inserted, by pushing, into the holder 10, some resistance may be encountered due to the compressed air being forced by the bottom of the bottle towards the bottom 18 of the holder 10. To allow escape of the compressed air and to facilitate positioning of the bottle within the opening 14, the aperture 20 allows the trapped air to escape from the bottom without being compressed and trapped within the opening 14.

The thickness of the container walls, that is the distance between the interior wall 22 and exterior wall 24 is sufficient to insulate the contents of a baby bottle and prevent it from being unduly heated or cooled to an undesirable degree. The substance from which the holder 10 can be manufactured is porous, resilient flexible and can be easily formed by methods known in the industry. The holder 10 is lightweight to a sufficient degree to allow an infant to grasp the holder by the handle means 26 and 28 and handle the holder 10 with a feeding bottle positioned within the holder 10 with ease and safety, since slipping out of the infant bottle is generally prevented by the compression force exerted by the walls of the holder 10 on the exterior walls of the baby bottle.

It is preferred that the holder 10 is formed as an integral unit without parts which can be dis-attached by an infant and present hazardous conditions for use of the holder 10.

Many changes and modifications can be made within the design of the present invention without departing from the spirit thereof. I, therefore, pray that my rights to the present invention be limited only by the scope of the appended claims.

I claim:

1. A beverage container holder, comprising:

a lightweight porous resilient insulating flexible holder body having an open top, bottom wall, a substantially cylindrical continuous side wall enclosing a container when the container is positioned within the holder body and a central opening extending from the open top to the bottom wall, said side wall being provided with a narrow elongated slot extending in substantially parallel relationship to a longitudinal axis of the holder to allow visual determination of a level of contents in the container positioned within the central opening;

a pair of handle means integrally formed at diametrically opposite sides of the continuous side wall, each of said handle means being oriented to extend in a generally vertical orientation, each of said handle means being formed by a convex outer surface and a concave inner surface, said inner surface being spaced from a continuous side wall to allow gripping of the handle means;

and wherein said central opening is defined by a continuous cylindrical inner wall which exerts a discreet compression force on the container, while frictionally engaging the container and preventing the container from sliding within the holder.

* * * * *